United States Patent [19]

Berglund et al.

[11] 4,345,843

[45] Aug. 24, 1982

[54] AGITATOR

[75] Inventors: Erling G. Berglund, Jäfälla; Hans J. Krook, Sollentuna, both of Sweden

[73] Assignee: Clinicon AB, Bromma, Sweden

[21] Appl. No.: 237,078

[22] Filed: Feb. 23, 1981

[30] Foreign Application Priority Data

Mar. 11, 1980 [SE] Sweden ..... 8001912

[51] Int. Cl.[3] ..... B01F 13/08

[52] U.S. Cl. ..... 366/219; 422/64; 422/99

[58] Field of Search ..... 366/114, 115, 127, 219, 366/273, 274; 422/64, 65, 99, 104

[56] References Cited

U.S. PATENT DOCUMENTS

| | | | |
|---|---|---|---|
| 1,734,975 | 11/1929 | Loomis et al. | 366/127 X |
| 2,876,083 | 3/1959 | Prietl | 366/127 X |
| 3,245,665 | 4/1966 | Steel | 366/273 X |
| 3,266,322 | 8/1966 | Negersmith et al. | 422/64 X |
| 4,007,011 | 2/1977 | Greaves et al. | 422/64 X |

*Primary Examiner*—Philip R. Coe

*Attorney, Agent, or Firm*—Browdy and Neimark

[57] ABSTRACT

An apparatus for oscillating a test tube so as to agitate the content thereof, comprises an annular holder from which the test tube can be hung by means of a flange located on the upper end of the test tube, in a manner such that the test tube is restricted swingable outwardly in all directions from its vertical rest position. Mounted externally of the test tube bottom is a plate of soft-magnetic material or a plate-shaped permanent magnet with its magnetic axis coinciding with the axis of the test tube. A plurality of electromagnets for example four in number, are stationarily arranged with their respective first poles located in a common horizontal plane at a distance beneath the lower end of the test tube, in a manner such that the poles lie on a circle concentrical about the vertical rest position of the test tube. The opposite second poles of the electromagnets are connected to a common, soft-magnetic pole piece, and the electromagnets are energized in a predetermined sequence and in predetermined directions, so that as a result of the co-action of said first poles of the electromagnets and the soft-magnetic plate or plate-shaped permanent magnet on the test-tube, the test-tube is caused to effect a nutational rotation about the vertical rest position, with the apex of the nutational rotation located substantially in the center of the annular holder.

11 Claims, 2 Drawing Figures

AGITATOR

Figure 1:
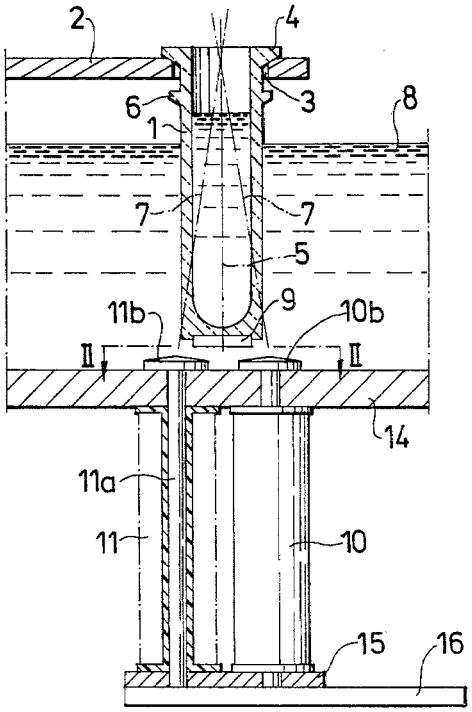

The present invention relates to apparatus for agitating the contents of a test tube.

In many cases there is a need for automatically operating apparatus, by means of which the contents of a test tube can be agitated or stirred in order, for example, to obtain a uniform concentration or temperature distribution in a liquid, in order to mix together different liquid constituents, or to prevent sedimentation. Hitherto known apparatus for this purpose can be divided substantially into three categories. The first category includes devices of the kind comprising a rod or wirelike stirrer or agitator which can be immersed into the contents of a test tube and caused to vibrate or oscillate. The construction and mode of operation of such an apparatus, however, are relatively complicated when said apparatus is to be used together with an apparatus, for example an automatically operating analyzing apparatus, in which a large number of test tubes are to be automatically brought in sequence to a position in which agitation of the contents of the test tubes can be effected. Moreover, there is a serious risk with such apparatus that as the agitator body is moved into and out of successive test tubes it will pick up droplets of the contents of one test tube and deposit these droplets in the test tube next in line, thereby contaminating the samples in the different test tubes.

The second category includes arrangements whereby each test tube includes a movable agitator body of soft-magnetic material or having the form of a permanent magnet, which can be caused to rotate or to move in some other fashion under the effect of a varying magnetic field generated by means arranged externally of the test tube, e.g. means in the form of electromagnets or rotary permanent magnets. The presence of a separate agitator body within the test tube makes it extremely difficult to clean the tube, thereby creating the risk of contamination between different samples. Furthermore, it may be difficult in many instances to ensure that the agitator body moves satisfactorily. THe use of a rotating permanent magnet outside the test tube to drive the agitator body located inside the tube also has the disadvantage that mechanically movable elements are required immediately outside the test tube, which may have serious consequences in some cases, since desirably the test tube is immersed in a temperature regulating bath at the same time as the contents of the test tube are agitated.

The third category includes devices comprising a mechanical vibrating or shaking mechanism which is mechanically coupled to the test tube for vibrating or shaking the same. Such a device also requires the provision of mechanically movable parts placed immediately on the outside of the test tube, resulting in the aforesaid disadvantage. Difficulties may also be encountered in mechanically coupling the test tube to the vibrating means in a simple and reliable fashion. This is particularly the case in automatically operating analyzing apparatus of the kind described above, in which it must be possible to advance in sequence a plurality of test tubes automatically to the vibration means and to couple successive test tubes temporarily thereto.

The object of the invention is therefore to provide an apparatus of the kind mentioned in the introduction with which the contents of a test tube can be effectively agitated; which does not require the provision of agitating bodies or agitating elements within the test tube itself; and which does not require the provision of mechanically movable parts outside the test tube or any form of mechanical coupling between the test tube and external vibration elements.

According to the invention an apparatus for shaking a test tube comprises an annular holder in which a test tube can be hung by means of a flange, which projects outwardly from the upper edge of the test tube and which rests against the annular holder in a manner such that the test tube is restricted swingable outwardly, in all directions, from a substantially vertical rest position; a member of magnetic material attached to the lower end of the test tube; at least three stationarily arranged electromagnets each having a first pole and a second pole, said first poles of the electromagnets being arranged with their pole faces located in a common, substantially horizontal plane, at a distance beneath the lower end of the test tube and on a circle substantially concentrial about the centre axis of the test tube in said rest position; and means for energizing the electromagnets in a given sequence, so that the test tube, as a result of the magnetic co-action between said magnetic member on the test tube and the said first poles of the electromagnets, is caused to effect substantially a nutational rotation around said rest position, with the point of the nutational rotation located substantially in the centre of the annular hole.

Figure 2:
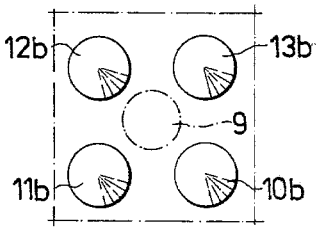

In the following the invention will be described in more detail with reference to the accompanying schematic drawing, in which:

FIG. 1 is a partly cut-away side view of an apparatus according to the invention shown by way of example, and FIG. 2 is a sectional view taken on the line II—II in FIG. 1, illustrating the mutual positioning of the poles of the electromagnets.

The exemplary embodiment of the apparatus according to the invention schematically illustrated in the drawing is intended for use with an automatically operating analyzing apparatus in which a large number of test tubes 1, of which only one is shown are carried around the periphery of a partially illustrated turntable 2 which is arranged for rotation about a vertical axis (not shown) and by means of which the test tubes can be brought successively to at least one location in which the test tubes can be vibrated or oscillated, in order to agitate the contents of said test tubes.

To this end the turntable 2 is provided around its periphery with circular openings 3 the number of which corresponds to the number of test tubes to be carried and through which said test tubes can extend. Each test tube is provided at its open end with a lip 4 which rests on the edge of a respective opening 3. Suitably the underside of the lip 4 is conically champered, as is also the edge of respective openings 3, the diameter of which openings is greater than the outer diameter of the test tubes 1. In this way the test tube 1 is able to swing freely in all directions from its vertical rest position, shown in FIG. 1 by the chain line 5. The test tube 1 is also conveniently provided with a further annular lip 6 so placed on said test tube as to be located at some distance from the undersurface of the table 2 and so as to co-act with said undersurface to limit the outward swing of the test tube 1 to a maximum permitted position, shown in FIG. 1 by the two chain lines 7. The test tubes 1 depending from the table 2 may, for example, be immersed in a temperature regulating bath 8, which is only partially shown and which is intended to keep the contents of respective test tubes at a given temperature.

For the purpose of oscillating the test tubes, in order to mix or agitate the contents thereof, each test tube is provided at its closed end, on the outer surface thereof, with a fixedly attached disc or plate 9 of a soft-magnetic material. Arranged at that location where the test tubes are to be oscillated are four electromagnets 10, 11, 12 and 13 (of which only the electromagnets 10 and 11 are visible in FIG. 1). As will be seen from FIG. 1, the electromagnets are mounted beneath the bottom 14 of the bath 8 with their iron cores, e.g. 11*a*, extending through the bottom 14 of said bath. On the upper surface of the bottom 14, each core is provided with a respective pole pin 10*b*, 11*b*, 12*b* and 13*b*. The opposite ends of the cores of respective magnets are connected to a common soft-magnetic pole piece 15 and can, to advantage, carry a circuit card 16 or like element containing the circuits for controlling the excitation of the magnets. As will be seen from FIG. 2, each pole pin 10*b*, 11*b*, 12*b*, 13*b* is placed in a respective corner of a rectangle centered about the rest position of the soft-magnetic plate 9 on the bottom of the test tube 1, i.e. are uniformly distributed about a circle which is concentrical relative to the centre line 5 of the test tube 1 in the rest position thereof.

When the test tube is to be vibrated or oscillated, the electromagnets are energized in a given sequence, in a manner such that at any given moment two mutually adjacent pole pins 10*b*–13*b* are magnetized simultaneously but with mutually opposite polarities, and the pair of simultaneously magnetized pole pins are displaced continuously in a given direction around the circle on which the pins lie. Thus, for example, if at a given moment in time the pole pins 10*b* and 11*b* are magnetized simultaneously, with the pole pin 10*b* having the polarity N and the pole pin 11*b* having the polarity S, in a following time interval the pole pins 11*b* and 12*b* will be magnetized simultaneously with the pin 11*b* having an S-polarity and the pin 12*b* having an N-polarity, while in a following time interval the pole pins 12*b* and 13*b* will be magnetized simultaneously with the pin 12*b* having an N-polarity and the pin 13*b* having an S-polarity, and in the next following time interval, the last magnetizing interval in the sequence, the pole pins 13*b* and 10*b* will be magnetized simultaneously with the pole pin 13*b* having an S-polarity and the pole pin 10*b* having a N-polarity. This repeated sequence in the excitation of the various electromagnets and the co-operation between the temporarily magnetized pole pins and the soft-magnetic plate 9 on the bottom of a respective test tube causes said test tube to oscillate and to execute a nutational motion, i.e. to move along an imaginary conical surface, e.g. the surface shown by the chain lines 7, with the apex located substantially in the centre of the opening 3 in the plate 2. As a result of said nutational motion, the liquid within the test tube is thrown around against the wall thereof, thereby effectively agitating the liquid. The speed at which the test tube is moved can be determined with the aid of the frequency of the excitation sequence of the electromagnets, thereby enabling said speed to be set to a value at which effective agitation is obtained.

It is appreciated that with the above-described excitation sequence, each electromagnet 10–13 will always be energized in the same direction each time it is energized. This is advantageous as it simplifies the excitation circuits of the electromagnets, but is not absolutely necessary for the correct operation of the apparatus. Thus, the pole pins 10*b*–13*b* of the electromagnets may also be magnetized according to following sequence:

| | Pole pin | | | |
|---|---|---|---|---|
| | 10b | 11b | 12b | 13b |
| Stage 1 | N | S | | |
| Stage 2 | | N | S | |
| Stage 3 | | | N | S |
| Stage 4 | S | | | N |

It has been found, however, that the above-described embodiment of an apparatus according to the invention may in some cases be sensitive to changes or deviations in the magnitude of the air gap between the soft-magnetic plate 9 on the test tube 1 and the pole pins 10*b*–13*b* of the elektromagnets 10–13.

This problem is eliminated when, according to another embodiment of the invention, the soft-magnetic plate 9 on the bottom of the test tube 1 is replaced with a plate- or disc-shaped permanent magnet having its magnetic axis coinciding with the axis of the test tube 1 i.e. the disc-shaped magnet has one magnetic pole at its upper surface and a second magnetic pole with opposite polarity at its lower surface.

In such an embodiment of the apparatus according to the invention the electromagnets 10–13 may be energized in such a sequence that at any given moment a single electromagnet, e.g. electromagnet 10, is energized to magnetize its pole pin, 10*b*, with a given polarity, e.g. N-polarity, and this energization is displaced continuously in a given direction around the circle of electromagnets. Thus, the magnetizing sequence of the pole pins 10*b*–13*b* may be the following:

| | Pole pin | | | |
|---|---|---|---|---|
| | 10b | 11b | 12b | 13b |
| Stage 1 | N | (S) | (S) | (S) |
| Stage 2 | (S) | N | (S) | (S) |
| Stage 3 | (S) | (S) | N | (S) |
| Stage 4 | (S) | (S) | (S) | N |

In this table brackets ( ) are used for indicating that the pole pin concerned will adopt the magnetic polarity stated within the brackets in spite of the fact that its associated electromagnet is not energized at the specific time concerned. This is due to the fact that all electromagnets 10–13 have the lower ends of their iron cones interconnected through the soft-magnetic pole piece 15. If the disc-shaped permanent magnet 9 on the bottom of the test tube 1 is oriented with its S-pole facing downwards towards the pole pins 10*b*–13*b*, it will be attracted towards the pole pin which at any given instant is magnetized with N-polarity. As a result, the test tube 1 will be caused to execute a nutational motion as described in the foregoing. This motion will, however, be more well-defined and less sensitive to changes in the air gap between the permanent magnet 9 and the pole pins 10*b*–13*b* than for the first described embodiment of the apparatus.

An even better and more reliable operation can be obtained if the plate or disc 9 is a permanent magnet as described above, but the electromagnets 10–13 are energized in such a sequence and with such polarities that at any given moment two mutually adjacent electromagnets are energized simultaneously in a direction such as to magnetize their pole pins with the same polarity and that the pair of simultaneously energized electromagnets are displaced continuously around the circle of electromagnets. The magnetizing sequence of the pole pins 10*b*–13*b* may in this case be the following:

| | Pole pin | | | |
|---|---|---|---|---|
| | 10b | 11b | 12b | 13b |
| Stage 1 | N | N | (S) | (S) |
| Stage 2 | (S) | N | N | (S) |
| Stage 3 | (S) | (S) | N | N |
| Stage 4 | N | (S) | (S) | N |

Brackets ( ) are here used with the same meaning as in the foregoing table. In this case the permanent magnet 9 on the test tube will in each instant be attracted towards the pair of pole pins 10*b*–13*b*, which at that instant are magnetized with a polarity opposite to the polarity of the lower surface of the permanent magnet, whereby the test tube is caused to execute a nutational motion as explained hereinbefore. It is appreciated that in this case it is unimportant which polarity the permanent magnet 9 has at its lower surface.

Although the illustrated and described embodiments of the invention comprise four electromagnets, which is considered a suitable number in practice, it will be understood that the number of magnets used may be greater or smaller than four, e.g. three, five or six. The apparatus according to the invention may also be modified in other respects within the scope of the invention. Further, it will also be understood that an apparatus according to the invention can also be used in connection with other apparatus than the automatic analyzing apparatus of the kind schematically illustrated in FIG. 1.

We claim:

1. An apparatus for shaking a test tube, comprising an holder with a circular hole therein in which a test tube can be hung by means of a flange, which flange projects outwardly from the upper edge of the test tube and which rests against the holder in a manner such that the test tube is restricted swingable outwardly, in all directions, from a substantially vertical rest position; a member of magnetic material attached to the lower end of the test tube; at least three stationarily arranged electromagnets each having a first pole and a second pole, said first poles of the electromagnets being arranged with their pole faces located in a common, substantially horizontal plane at a distance beneath the lower end of the test tube and on a circle substantially concentrical about the centre axis of the test tube in said rest position; and means for energizing the electromagnets in a given sequence so that the test tube, as a result of the magnetic co-action between said magnetic member on the test tube and the said first poles of the electromagnets, is caused to effect substantially a nutational rotation around said rest position, with the point of the nutational rotation located substantially in the centre of the circular hole.

2. An apparatus as claimed in claim 1, wherein said magnetic member on the test tube is soft-magnetic, and the electromagnets are energized in such a sequence and with such polarities that in each instant two mutually adjacent of said first poles are magnetized simultaneously with opposite polarities and the pair of simultaneously magnetized first poles is displaced continuously around said circle of first poles.

3. An apparatus as claimed in claim 2, wherein the electromagnets are of an even number, and each electromagnet is magnetized with the same polarity at each magnetizing operation.

4. An apparatus as claimed in claim 1, wherein said member on the test tube is a permanent magnet oriented with its magnetic axis substantially coinciding with the axis of the test tube, and the electromagnets are energized in such a sequence and in such directions that in each instant one of said first poles is magnetized with a first polarity, whereas the remaining first poles are magnetized with a second polarity opposite said first polarity, and the first pole magnetized with said first polarity is displaced continuously around said circle of first poles.

5. An apparatus as claimed in claim 1, wherein said member on the test tube is a permanent magnet oriented with its magnetic axis substantially coinciding with the axis of the test tube, and the electromagnets are energized in such a sequence and in such directions that in each instant two mutually adjacent of said first poles are magnetized simultaneously with a first polarity, whereas the remaining first poles are magnetized with a second polarity opposite said first polarity, and the pair of first poles simultaneously magnetized with said first polarity is displaced continuously around said circle of first poles.

6. An apparatus as claimed in claim 4 or 5, wherein said permanent magnet attached to the test tube is oriented to have a pole with said second polarity facing said first poles of the electromagnets.

7. An apparatus as claimed in claim 1, wherein said second poles of the electromagnets are connected to a soft-magnetic pole piece, which is common to all electromagnets.

8. An apparatus as claimed in claim 1, wherein the electromagnets are bar-magnets and are arranged side by side parallel with one another.

9. An apparatus as claimed in claim 1, wherein the magnetic member has the form of a plate mounted on the outside of the bottom of the test tube.

10. An apparatus as claimed in claim 1, wherein said flange on the test tube has a conically chamfered lower edge; and the edge of said holder supporting the test tube has a corresponding conical chamfer.

11. An apparatus as claimed in claim 1, wherein the test tube is provided with a further, external, ring-shaped flange arranged at a distance from the upper end of the test tube such that said flange is located at a distance from the underside of the holder so as to co-act with said holder to restrict the maximum extent to which the test tube can swing from its rest position.

* * * * *